United States Patent [19]

Galves et al.

[11] Patent Number: 4,906,892

[45] Date of Patent: Mar. 6, 1990

[54] HIGH LUMINANCE COLOR SCREEN FOR CATHODE RAY TUBE AND METHOD FOR MAKING A SCREEN OF THIS TYPE

[75] Inventors: Jean P. Galves, Meylan; Pierre Merloz, Le Grand Lemps, both of France

[73] Assignee: Thomson-CSF, Paris, France

[21] Appl. No.: 269,010

[22] Filed: Nov. 9, 1988

[30] Foreign Application Priority Data

Nov. 13, 1987 [FR] France ..... 87 15674

[51] Int. Cl.[4] ..... H01J 29/26; H01J 29/28; H01J 9/22

[52] U.S. Cl. ..... 313/466; 313/473; 427/64

[58] Field of Search ..... 313/473, 466; 427/64

[56] References Cited

U.S. PATENT DOCUMENTS

| | | | |
|---|---|---|---|
| 2,590,018 | 3/1952 | Koller et al. | 313/473 |
| 3,231,775 | 1/1966 | Pritchard | 313/473 |
| 3,517,243 | 6/1970 | Jones | 313/473 |
| 3,603,830 | 9/1971 | Gallaro et al. | 313/473 |

FOREIGN PATENT DOCUMENTS 2356266 1/1978 France .

*Primary Examiner*—Palmer C. DeMeo

*Attorney, Agent, or Firm*—Oblon, Spivak, McClelland, Maier & Neustadt

[57] ABSTRACT

Disclosed is a high luminance color screen for cathode tubes, comprising two fluorescence luminophors of different colors, the visible trace of which, under the effect of electron bombardment, has a color which can be adjusted by the acceleration voltage of the beam of said electrons. Said voltage is variable, during operation, between two extreme values $V_o$ and $V_1$, in which the two luminophors are arranged on the transparent support of said screen is superimposed layers formed by powders of crystals of each of the said luminophors, separated from one another by plane faces. Said screen is characterized mainly by the fact that the barrier with plane faces comprises a first layer of silicon dioxide, a layer of zinc sulfide and a second layer of silicon dioxide, the layer of zinc sulphide being included between the two layers of silicon dioxide.

5 Claims, 1 Drawing Sheet

HIGH LUMINANCE COLOR SCREEN FOR CATHODE RAY TUBE AND METHOD FOR MAKING A SCREEN OF THIS TYPE

BACKGROUND OF THE INVENTION

1. Field of the Invention

The invention concerns a screen for cathode ray tubes with traces of high luminance and color which can be adjusted by the acceleration voltage of the beam. In particular, it concerns the structure of this screen. It also concerns a method for making this screen.

2. Description of the Prior Art

In the prior art, there are so-called penetration cathode tube luminescent screens wherein the color of the trace varies with the acceleration voltage of the electron beam.

These luminescent cathode screens have two luminophors with different fluorescence levels, which shall be taken to be green and red in the rest of the description. They are represented schematically in the form of two homogeneous layers, each consisting of one of the luminophors, which may or may not be separated by an inert or non-luminescent material emitting no light under the effect of an electron bombardment.

Depending on the value of the beam acceleration voltage V, i.e. depending on the energy of the electrons of the beam, only the first of these layers, which will be assumed to be the layer with red fluorescence in the rest of this description, is excited by the beam, or else, if this voltage is sufficient, this layer or the entire second layer or a part of the second layer, made of a luminophor with green fluorescence, undergoes excitation by the beam. The green fluorescence begins to be excited only from a certain value of this voltage onwards, namely from the voltage sufficient for the energy of the electrons to enable them to penetrate the screen (whence the above expression 'penetration screens') up to the green luminophor layer, after crossing the red luminophor layer and, as the case may be, the inert layer. This value of the voltage shall be called $V_o$ in the rest of the description. The green fluorescence predominates and the trace takes on the color green. Between the two values, $V_o$ and $V_1$, there are obtained, depending on the value of V, intermediate colors between green and red depending on the proportions of the two excited fluorescences in the trace.

There are various known prior art penetration screen structures.

One of them comprises layers of red and green luminophors separated by a layer of an inert material, all obtained by evaporation under vacuum in the form of thin films (Cf. patent on behalf of Feldmen, delivered in the United States of America with the number 3 225 238). This type of screen has the drawback of displaying extremely low luminance under electron bombardment because it is impossible for the radiation emitted in these films to emerge from them owing to the multiple reflections that they undergo.

Another of these structures has a mixture of crystals of the two luminophors, red and green, the crystals of this mixture having been coated, prior to the mixing operation, with a film of inert material. Generally, with these mixtures, a luminance is obtained which is substantially greater than that of the previous structure.

In a third prior art structure (see the U.S. Pat. No. 3,714,490 delivered in the U.S.A.), the red luminophor is integrated in the structure in the form of small-sized grains surrounding the inert layer coating bigger grains of green luminophor. The luminance of the red luminophor is thus substantially improved, but the problem to be resolved is really that of increasing the total luminance of the screen, namely luminance of all the traces and not only that given by the red luminophor. At the same time as this red luminophor luminance is increased, the luminance of the green luminophor should be increased in the same proportions for it is this proportion which sets the extent of the range of shades obtained between red and green from the moment when the green fluorescence begins to be excited by the acceleration voltage, namely from the value $V_o$ above. It is generally desired to have this entire range available in order to display all the information. This range is narrowed down if the increase in the luminance of the red luminophor is not accompanied by that of the green luminophor.

In a fourth prior art structure, as shown in FIG. 1, the screen consists of superimposed layers and, as set out in detail further below, it has the following elements:

- a transparent support 1, made of glass, forming the screen proper;
- a layer 2 of a green luminophor made up of crystals 10, said layer being deposited according to a well known sedimentation technique;
- a barrier layer 3 comprising a transparent inert material. This layer is conventionally made either of zinc sulphide (ZnS) or silicon oxide ($Si0_2$);
- a layer 4 of a red luminophor made up of crystals 40, said layer being deposited either by centrifugation, with the support 1 rotating on an axis parallel to its plane, or by fixing the screen on a spinner, the axis of which is the same as that of the screen. The thickness deposited depends on the operating voltages of the tube. The crystals are either yttrium vanadate or yttrium oxysulphide or gadolinium oxide doped with europium;
- and finally, a thin conductive layer, generally made of aluminium. This layer is taken to the high voltage of the tube and enables the removal of the electrostatic charges. It is also used as a reflector in order to obtain a one-directional radiation.

The barrier layer 3 is deposited after the deposition of the first luminophor 2 in the following way:

- an organic film is made by known methods on the layer of green luminophor, said film acting as a temporary support for the inert material forming the barrier layer 3. The material used is generally a polymer, butyl metacrylate, and it is formed by wet deposition on the screen of a solution containing this product. After the water evaporates, the film is bonded to the layer of green luminophor. Another approach uses a nitrocellulose film made in a standard way according to the prior art;
- then the inert material is deposited by vacuum evaporation, either by Joule effect or by an electron gun. The thickness deposited is measured and adjusted by known means in order to achieve the desired thickness which makes it possible to obtain the desired threshold voltage forming a barrier to electrons with excessively low energy.

The temporary organic film is removed during the subsequent heat treatments applied to the cathode tube.

The deposition of this temporary supporting film is indispensable for the inert layer to have a plane surface and a thickness which is as constant as possible throughout its range, in order to obtain proper functioning of the screens.

Now, following the manufacture of screens with this latter structure, it has been observed that the characteristics of these screens are not as good as expected. For, after the observation of the structure, it has been observed, in fact, that the barrier layer deteriorates during manufacture, and this deterioration takes the form of cracks in the inert material.

For, during the vacuum evaporation, the inert material, when it is silicon oxide, undergoes stretching stresses which cause cracks, and also cause tearing in the organic film.

When the material is zinc sulphide, the stresses undergone by this layer are compressive stresses, and the layer has no cracks. This water-sensitive material no longer has good optical transmission after having undergone all the screen finishing operations.

Furthermore, the high index of zinc sulphide ($n=2.3$) limits optical transmission, especially that of red radiation coming from the red luminophor.

The present invention makes it possible to overcome all these drawbacks. An object of the present invention is a high luminance color screen for cathode ray tubes, wherein the barrier layer has all the following characteristics: high quality optical transparency, uniform thickness adapted to the stopping of electrons, sound mechanical solidity and chemical stability under vacuum, under electron bombardment, and in the presence of various products such as water or organic solvents.

SUMMARY OF THE INVENTION

The invention thus concerns a high luminance color screen for cathode tubes comprising two fluorescence luminophors of different colors, for which the trace visible under the effect of electron bombardment has a color which can be adjusted by the acceleration voltage of said electron beam, said acceleration voltage being variable, during operation, between two extreme values $V_o$ and $V_1$, wherein the two luminophors are placed on the transparent support of said screen in superimposed layers made of powders of crystals of each of said luminophors, separated from one another by a barrier with plane faces, wherein the barrier with plane faces has a first layer of silicon dioxide, a layer of zinc sulphide and a second layer of silicon dioxide, the zinc sulphide layer being included between the two layers of silicon dioxide.

Another object of the invention is the making of a barrier in which the silicon dioxide layers have a thickness substantially equal to $0.1\mu m$, in order to use the overall refraction index of the barrier to the minimum, increase optical transmission, provide shielding for the zinc sulphide and maintain the internal compressive stresses.

Another object of the invention is the making of a screen wherein the constituent powder of the deepest luminophor layer of the screen, called the first layer, namely the layer in contact with the support, is made of phosphorus $P_1$ according to the J.E.D.E.C. specification and has a grain size of 6 micrometers or less, and wherein the constituent powder of the other luminophor layer, called the second layer, is europium-doped yttrium vanadate and has a grain size of 0.6 micrometers, and wherein these layers have thicknesses substantially corresponding to respective weights of 1 mg to 3 mg and 0.15 milligrams per square centimeter.

Another object of the invention is a screen wherein the minimum operating voltage is 7 to 10 kV and the maximum voltage is 12 to 17 kV.

Another object of the invention is a screen wherein the traces have the color green (550 nm) and the color red (610 nm) at the minimum voltage.

The invention further consists in a method for making a high luminance color screen for cathode ray tubes, wherein the following steps are performed in succession:

- depositing the first layer of luminophor on the transparent screen;
- depositing an organic film on this first layer of luminophor;
- depositing the first layer of silicon oxide;
- depositing the layer of zinc sulphide on the layer of silicon oxide;
- depositing the second layer of silicon oxide on the layer of zinc sulphide, the latter three layers forming an inert material constituting a barrier against the electrons which have an acceleration voltage below the voltage threshold forming this barrier;
- depositing the first layer of luminophor on the second layer of silicon dioxide;
- depositing an electrically conductive layer;
- eliminating the organic layer by heat treatment of the structure.

BRIEF DESCRIPTION OF THE DRAWING

Other specific features and advantages will appear more clearly from the following detailed description, made with reference to the appended drawing, which is given purely as a non-restrictive example, and in which.

DESCRIPTION OF A PREFERRED EMBODIMENT

Figure 1:
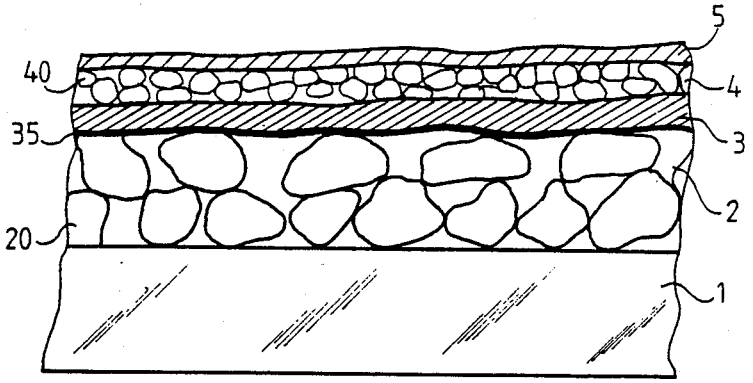
FIG 1 PRIOR ART
FIG. 1 shows a schematic view of a screen structure according to the prior art already described.
Figure 2:
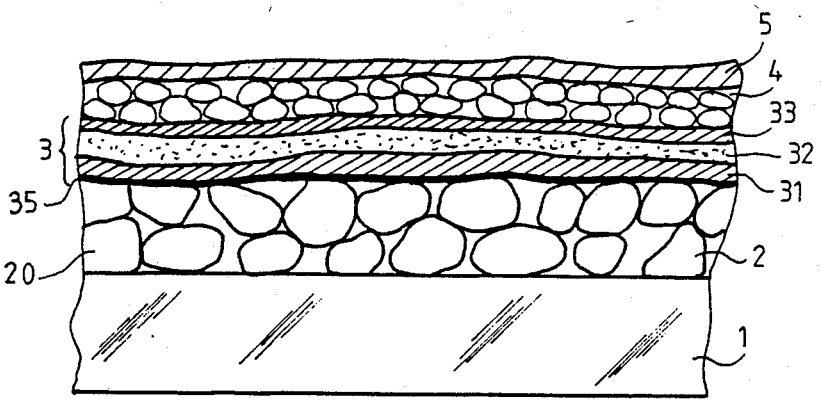
FIG. 2 shows a schematic view of a screen structure according to the invention.

In FIGS. 1 and 2, the same references are repeated for the same elements. These figures show a portion of a penetration screen and, more especially, the constituent structure of these screens. FIG. 2 shows a thick glass support 1, a layer made up of a green luminophor powder, a barrier 3 made of an inert material, a layer made up of a red luminophor powder 4 and a thin conductive layer 5.

The screen shown in this FIG. 2 is made as shall be explained below:

On the thick glass support, there is deposited the layer 2 of type Pl green luminophor powder, in accordance to the J.E.D.E.C. specification as published by the "Electronic Industry Association", Engineering Department. The deposition is done according to a known technique, for example sedimentation. The powder in question has a grain size of about six micrometers. The quantity deposited is 3 milligrams per square centimeter.

Then, the different layers forming the barrier 3 are deposited.

First of all, a temporary support is deposited. This temporary support is made up of an organic film 35. This support 35 is used to obtain a plane surface for the barrier. Without this temporary surface, there would be infiltrations through the crystals 20 of the green luminophor when the barrier is being made.

To make the organic film 35, a polymer is used. This polymer is butyl metacrylate in solution, which gets bonded to the layer of luminophor 2 after the water evaporates.

This temporary organic film 35 is removed during the subsequent heat treatments applied to the cathode tube.

Thus, on this film 35, there is deposited a first layer 31 formed by an inert material. This material is silicon dioxide ($SiO_2$). The deposition is achieved by a standard method for vacuum evaporation of silicon dioxide by means of an electron gun. This techniques further makes it possible to check the uniformity of the deposit and to obtain the desired thickness.

Then, a layer 32, made up of an inert material of a different nature, is deposited. This material is zinc sulphide. The deposition is also achieved by vacuum evaporation of the zinc sulphide by Joule effect using a molybdenum crucible containing the zinc sulphide. The thickness is also controlled automatically by standard means. It is this thickness that sets the barrier threshold for the electrons. In controlling this thickness, the desired threshold $V_o$ is obtained. The electrons, which have an acceleration voltage smaller than the voltage $V_o$, are stopped and the electrons which have a voltage greater than $V_o$ go through the barrier. Then, on this layer of zinc sulphide 32, a second layer of silicon dioxide 33 is deposited. This deposit is done in the same way as the first layer 31, namely by vacuum evaporation of the silicon dioxide by means of an electron gun.

On top of this second laayer of silicon dioxide 33, the layer of the second luminophor is deposited. This is a red luminophor powder with a grain size substantially finer than that of the layer 2, namely, 0.6μm approximately. This powder consists of either yttrium vanadate or an yttrium oxysulphide or gadolinium oxide doped with europium.

The depositing is done by centrifugation. The support 1 rotates on an axis parallel to its plane, or the deposition is done by fixing the supporting screen to a spinner, the axis of which is identical to that of the screen. The deposited thickness depends on the operating voltages of the tube. For a voltage $V_o$ of 10 kV, and a barrier of inert material 3 with a thickness of 1.2μm, the red luminophor layer 4 is 0.15 mg./cm$^2$.

Then, the conductive layer forming an aluminium film is deposited. This conductive layer is carried, during operation, to the high voltage of the tube. The screen thus formed works with a high voltage V1 of 17kV . To these voltages of 10 kV and 17 kV, there correspond the colors of the red and green traces, equal to 610 nanometers and 550 nanometers respectively.

When the tube is finished, the penetration screen structure according to the invention is thus in the form of superimposed polycrystalline layers, between which a barrier is placed. This barrier consists of an inert material in the form of three layers: a layer of zinc sulphide and two layers of silicon dioxide, the layer of zinc sulphide being held between the layers of silicon dioxide. The thicknesses of the silicon dioxide layers are practically independent of the operating voltages $V_o$ and $V_1$, and are chosen to improve the optical transmission of the zinc sulphide layer which has a high refraction index. By choosing a thickness of 1000±50 angstroms, the total refraction index of the barrier is reduced and, consequently, optical transmission is improved.

What is claimed is:

1. A high luminance color screen for cathode tubes comprising two fluorescence luminophors of different colors, for which the trace visible under the effect of electron bombardment has a color which can be adjusted by the acceleration voltage of said electron beam, said acceleration voltage being variable, during operation, between two extreme values $V_o$ and $V_1$, wherein the two luminophors are placed on the transparent support of said screen in superimposed layers made of powders of crystals of each of said luminophors, separated from one another by a barrier with plane faces, wherein the barrier with plane faces has a first layer of silicon dioxide, a layer of zinc sulphide and a second layer of silicon dioxide, the zinc sulphide layer being included between the two layers of silicon dioxide.

2. A high luminance color screen according to claim 1, wherein the constituent powder of the deepest luminophor layer of the screen, called the first layer, namely the layer in contact with the support, is made of phosphorus $P_1$ according to the J.E.D.E.C. specification and has a grain size of six micrometers or less, and wherein the constituent powder of the other luminophor layer, called the second layer, is europium-doped yttrium vanadate and has a grain size of 0.6 micrometers, and wherein these layers have thicknesses substantially corresponding to respective weights of 1 mg to 3 mg and 0.15 milligrams per square centimeter.

3. A screen according to claim 1 or 2, wherein each layer of silicon dioxide of the barrier has a thickness substantially equal to 0.1 micrometer, tending to improve the refraction index of this barrier.

4. A screen according to claim 1 or 2, wherein the minimum operating voltage is between 7 kV and 10 kV and the maximum voltage is between 12 kV and 17 kV.

5. A method for making a high luminance color screen for cathode ray tubes according to claim 1, wherein the following steps are performed in succession:

depositing the first layer of luminophor on the transparent screen;

depositing an organic film on this first layer of luminophor;

depositing the first layer of silicon oxide;

depositing the layer of zinc sulphide on the layer of silicon oxide;

depositing the second layer of silicon oxide on the layer of zinc sulphide, the latter three layers forming an inert material constituting a barrier against the electrons which have an acceleration voltage below the voltage threshold forming this barrier;

depositing the first layer of luminophor on the second layer of silicon dioxide;

depositing an electrically conductive layer;

eliminating the organic layer by heat treatment of the structure.

* * * * *